US009361861B2

(12) United States Patent
Iwase

(10) Patent No.: US 9,361,861 B2
(45) Date of Patent: Jun. 7, 2016

(54) WEIGHT FOR KEY AND KEY FOR KEYBOARD MUSICAL INSTRUMENT

(71) Applicant: KAWAI MUSICAL INSTRUMENTS MANUFACTURING CO., LTD., Hamamatsu-shi, Shizuoka-ken (JP)

(72) Inventor: Masahiko Iwase, Hamamatsu (JP)

( * ) Notice: Subject to any disclaimer, the term of this patent is extended or adjusted under 35 U.S.C. 154(b) by 0 days.

(21) Appl. No.: 14/569,195

(22) Filed: Dec. 12, 2014

(65) Prior Publication Data

US 2015/0170619 A1 Jun. 18, 2015

(30) Foreign Application Priority Data

Dec. 13, 2013 (JP) ..... 2013-258127

(51) Int. Cl.
*G10C 3/12* (2006.01)
*G10H 3/20* (2006.01)

(52) U.S. Cl.
CPC ... *G10C 3/12* (2013.01); *G10H 3/20* (2013.01)

(58) Field of Classification Search
CPC ..... G10C 3/12
See application file for complete search history.

(56) References Cited

U.S. PATENT DOCUMENTS 1,510,663 A * 10/1924 Finnimore ..... G10C 3/12 84/433
4,974,819 A * 12/1990 Reichard ..... F16F 13/262 188/312
6,531,651 B2 * 3/2003 Kanemitsu ..... G10C 3/125 84/433
6,774,294 B2 * 8/2004 Kugimoto ..... G10C 3/12 84/423 R
7,067,730 B2 * 6/2006 Inoue ..... G10C 3/12 411/451.1
7,129,404 B2 * 10/2006 Inoue ..... G10C 3/12 84/243
7,186,907 B2 * 3/2007 Inouye ..... G10C 3/12 84/236
7,345,235 B2 * 3/2008 Izutani ..... G10C 3/12 84/718
7,608,772 B2 * 10/2009 Kato ..... G10C 3/12 84/423 R
7,633,002 B2 * 12/2009 Inouye ..... G10C 3/12 84/432
7,807,911 B2 * 10/2010 Izutani ..... G10C 3/12 411/451.1
7,999,162 B2 * 8/2011 Izutani ..... G10C 3/12 84/174
8,921,676 B2 * 12/2014 Iwase ..... G10C 3/12 84/433
2004/0123728 A1 * 7/2004 Inoue ..... G10C 3/12 84/719
2014/0290464 A1 * 10/2014 Iwase ..... G10C 3/12 84/433
2015/0170619 A1 * 6/2015 Iwase ..... G10H 3/20 84/433

* cited by examiner

*Primary Examiner* — Robert W Horn
(74) *Attorney, Agent, or Firm* — Koppel, Patrick, Heybl & Philpott

(57) ABSTRACT

A weight for a key of a keyboard musical instrument that is to be inserted and secured in an attachment space, provided to the key, is provided. The weight includes: a weight body portion; and a corrugated portion, disposed in at least one portion of a lateral surface of the weight body portion, the lateral surface being located around an axis extending in an inserting direction of the weight body portion into the attachment space, the corrugated portion including a plurality of corrugations aligned in the inserting direction. The weight body portion and the corrugated portion are made of an elastic material.

3 Claims, 3 Drawing Sheets

WEIGHT FOR KEY AND KEY FOR KEYBOARD MUSICAL INSTRUMENT

CROSS-REFERENCE TO RELATED APPLICATIONS

This application claims the benefit of Japanese Patent Application No. 2013-258127 filed Dec. 13, 2013 in the Japan Patent Office, and the entire disclosure of Japanese Patent Application No. 2013-258127 is incorporated herein by reference.

BACKGROUND

The present invention relates to a weight for a key and a key for a keyboard musical instrument.

In an electronic piano, metal weights are attached to keys so that the touch, produced when the keys are depressed, becomes similar to the touch of a grand piano. A ground piano produces a light touch in response to a soft stroke, and a heavy touch in response to a strong stroke.

Attachment of metal weights with respect to keys has been done by adhesion in which an attachment space is created within each key. While the key is in a normal alignment state, the attachment space is open toward the bottom surface of a key. A metal weight is inserted through the opening into the attachment space and adhered therein. Alternatively, the attachment has been done by, for example, so-called insert molding, in which metal weights are embedded inside of keys.

SUMMARY

However, the above-described adhesion method, wherein weights are adhered to keys, requires too much work: application of an adhesive agent to inside of the attachment space and insertion of a weight into the attachment space has to be done for every key. Besides, waiting time is necessary for the adhesive agent to be hardened. On the other hand, the above-described insert molding requires a mold for exclusive use. If various types of weights are needed, a plurality of molds has to be prepared corresponding to the number of weight types, which is likely to increase the cost.

The present invention preferably provides an inexpensive weight for a key that can be easily attached to the key. The present invention also preferably provides a key to which such weight is attached.

A weight for a key of a keyboard musical instrument according to the present invention is to be inserted and secured in an attachment space, provided to the key, the weight including: a weight body portion; and a corrugated portion, disposed in at least one portion of a lateral surface of the weight body portion, the lateral surface being located around an axis extending in an inserting direction of the weight body portion into the attachment space, the corrugated portion including a plurality of corrugations aligned in the inserting direction. The weight body portion and the corrugated portion are made of an elastic material.

When the weight according to the present invention is inserted into the attachment space, the corrugated portion is interposed between the weight body portion and a wall, defining the attachment space, and elastically deformed. Frictional force is consequently generated between the corrugated portion and the wall defining the attachment space. Therefore, the weight can be secured within the attachment space by simply being inserted therein.

As a result, use of the weight according to the present invention allows an incredibly simple attachment of the weight with respect to a key. Moreover, the use of the weight dispenses with adhering a weight to a key, which is required, for example, if the weight is made of metal, and with enclosing a weight inside of a key, which is required, for example, in insert molding.

The elastic material may be rubber or resin with elasticity, such as elastomer. The material is, however, not limited to these materials.

Moreover, the weight according to the present invention may include metal powder in order to increase the weight thereof.

Furthermore, in the weight according to the present invention, each of the corrugations may be linearly formed along a direction perpendicular to the inserting direction. The weight, including the corrugated portion in the weight body portion, may be easily manufactured by extrusion molding or compression molding.

The weight according to the present invention is preferably made in such a manner that, when the weight is attached to the key, the key has a static load of 45 g to 80 g at a position 23 mm away from a tip of the key. The static load is more preferably 50 g to 70 g, and furthermore preferably 53 g to 57 g.

BRIEF DESCRIPTION OF THE DRAWINGS

The present invention will now be described by way of example with reference to the accompanying drawings, in which.

DETAILED DESCRIPTION OF THE PREFERRED EMBODIMENTS

Figure 1:
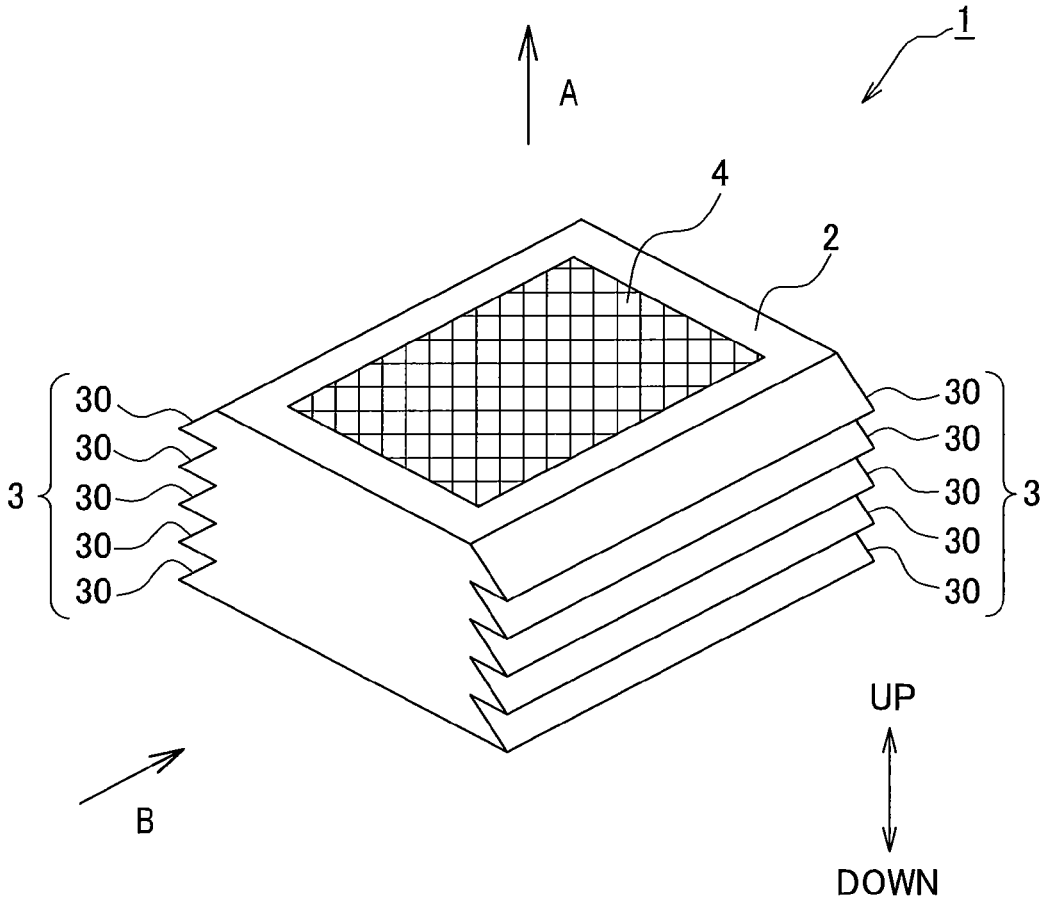
FIG. 1 is a perspective view showing a weight for a key according to the present invention.

A weight 1 for a key according to the present embodiment is made of rubber containing iron powder mixed therein and, as shown in FIG. 1, includes a weight body portion 2 and a corrugated portion 3. The direction indicated by an arrow A in FIG. 1 is an inserting direction of the weight body portion 2 (an inserting direction into an attachment space, which will be described hereinafter).

The weight body portion 2 is formed in a rectangular parallelepiped manner. In FIG. 1, the surface of the weight body portion 2, to which both-sided tape 4 is adhered, is defined as the top surface of the weight body portion 2.

The corrugated portion 3 may be provided in one portion or the entire portion of the lateral surface of the weight body portion 2. The lateral surface is located around an axis extending in the inserting direction A.

In the present embodiment, the corrugated portion 3 is formed on one pair of opposing lateral surfaces, which are determined among the four lateral surfaces of the weight body portion 2 excluding the top surface of the weight body portion 2 and the bottom surface facing the top surface. More particularly, the corrugated portion 3 is formed on two lateral surfaces, which are determined among the above-mentioned four lateral surfaces and disposed in parallel to the longitudinal direction B of the weight body portion 2. The inserting direction A and the longitudinal direction B are perpendicular to each other.

The corrugated portion 3 includes a plurality of corrugations 30. Each of the corrugations 30 is formed in a linear manner (longitudinal manner) along the longitudinal direction B (in parallel to the longitudinal direction B). The plurality of the corrugations 30 is aligned in the inserting direction A. In the present embodiment, five corrugations 30 are formed.

Figure 3:
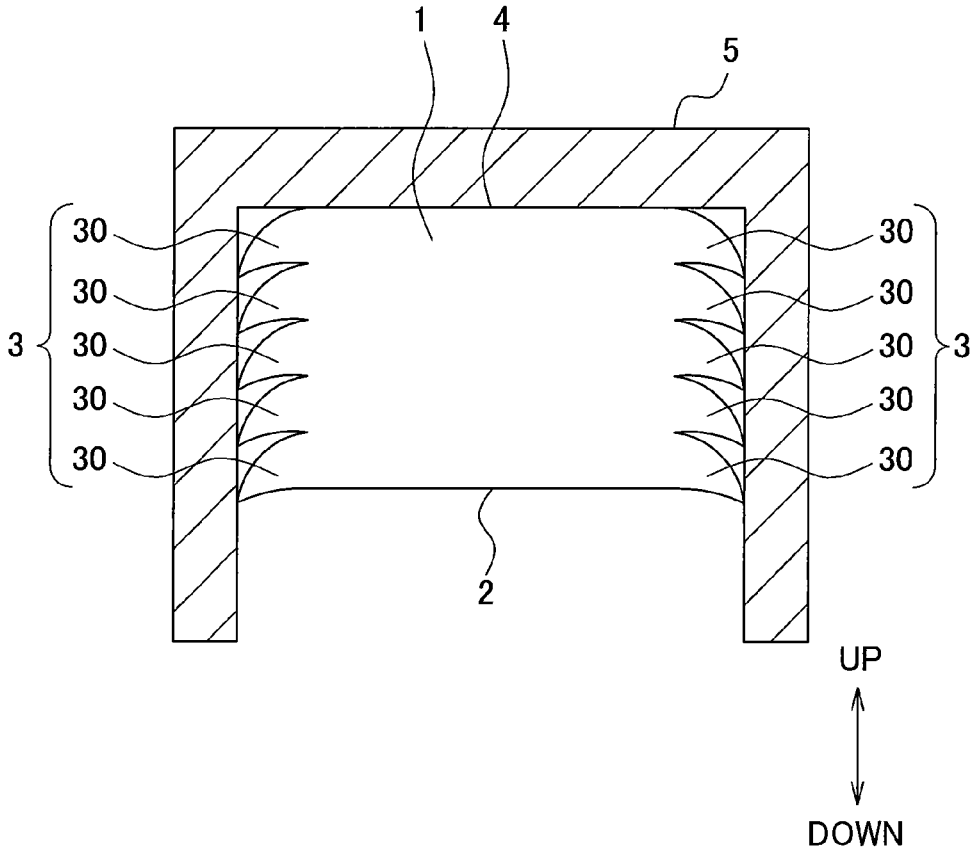
FIG. 3 is a cross-sectional view taken along the line III-III in FIG. 2.

The corrugated portion 3 is formed in a serrated manner as seen from the direction of the arrow extending in the longitudinal direction B (also see FIG. 3). The cross-section of each corrugation 30 (the cross-section of the surface perpendicular to the longitudinal direction B) is approximately in a right-angled triangular shape. Specifically, each of the corrugation 30 is formed such that, in the view from the direction of the arrow extending in the longitudinal direction B, the upper surface of the corrugation 30 is inclined with respect to the horizontal direction (the upper surface extends obliquely downward from the side of the weight body portion 2 (root side) toward a tip side), and the lower surface of the corrugation 30 extends perpendicularly to the weight body portion 2 (parallel to an installation surface (installation surface of an electronic piano).

On the top surface of the weight body portion 2, constituting the weight 1 for a key according to the present embodiment, the both-sided tape 4 may be adhered.

Now, the following explains about keys of an electronic piano, to each of which the above-described weight 1 is attached.

Figure 2:
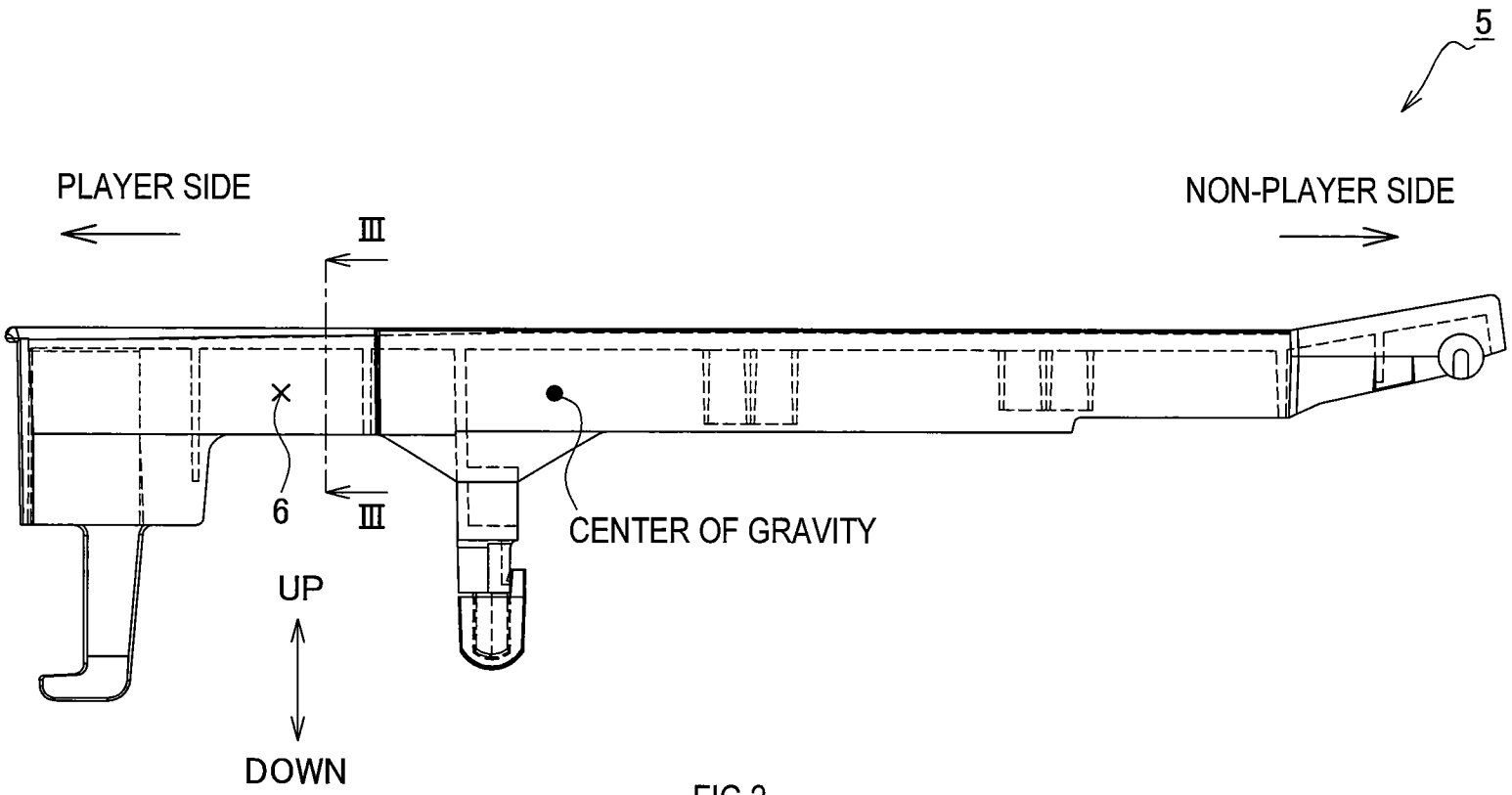
FIG. 2 is a front elevation showing a key of an electronic piano, to which the weight according to the present invention is to be attached, and showing the inner structure of the key in a transparent manner.

As shown in FIG. 2, a key 5 according to the present embodiment includes an attachment space 6, in which the above-described weight 1 is attached.

The center of gravity of the key 5 is located in a central portion of the key 5 in the longitudinal direction. The attachment space 6 is disposed in the player side with respect to the center of gravity.

The attachment space 6 is in a box-like shape and is downwardly open while the key 5 is in a normal attachment state with respect to the electronic piano.

When the above-described weight 1 is attached to the key 5, the weight 1 is cut into an appropriate size so that the key 5 has a static load of 45 g to 80 g at a position that is 23 mm away from the tip of the key 5.

The weight 1 may be manufactured by extruding molding and may be cut into an appropriate size in the molding process, or immediately before being attached to one of the keys 5.

The weight 1 is pushed upward so as to be inserted into the attachment space 6 of the key 5.

When the weight 1 is inserted into the attachment space 6, the corrugated portion 3 is elastically deformed and comes in contact with a wall portion defining the attachment space 6. At that time, frictional resistance can be generated between the corrugated portion 3 and the wall portion defining the attachment space 6. As a result, the weight 1 is secured in the attachment space 6 only by being inserted therein.

Moreover, in the present embodiment, if the both-sided tape 4 is adhered to the top surface of the weight 1, and when the weight 1 is inserted into the attachment space 6 and the top surface of the weight 1 comes in contact with the inner wall surface of the attachment space 6 (when the both-sided tape 4 comes in contact with the inner wall surface of the attachment space 6), the weight 1 is further secured in the attachment space 6 by the both-sided tape 4.

The entire portion of the weight 1 according to the present embodiment is made of rubber, which is an elastic material and allows cutting. Therefore, the weight 1 can be formed with suitable weight for any key 5 of various types of electronic pianos.

Using the weight 1 according to the present embodiment dispenses with adhesion, which is required in the case of a metal weight being attached to a key, and with enclosure of a weight inside of a key, which is required in the case of insert molding. Therefore, the weight 1 can be attached to the key 5 in an incredibly simple manner.

Moreover, in the weight 1 according to the present embodiment, the corrugations 30, constituting the corrugated portion 3, are formed in a linear manner (longitudinal manner) in a direction perpendicular to the inserting direction A. In other words, the corrugations 30 are linearly formed along the longitudinal direction B. In this case, the weight 1 can be made by extrusion molding. That is to say that the weight 1 can be easily manufactured by extrusion molding.

The weight 1 according to the present embodiment is attached in the player side with respect to the center of gravity in the key 5, which effectively increases the inertia in the rotational direction of the key 5. Therefore, sufficient effect can be achieved even with the weight 1 in a small size.

Other Embodiment

Although the above has explained an embodiment, the invention disclosed in the claims is not limited to the above-described embodiment. The invention can be carried out in various ways.

The weight 1 in the above-described embodiment is merely an example, and is not limited to this example.

In the above-described embodiment, rubber is used as an example of the material constituting the weight 1. However, the material is not limited to rubber. Alternatively, for example, soft resin such as thermoplastic elastomer or any type of elastic material may be used. Moreover, although metal powder is mixed in rubber in the above-described embodiment, the additive is not limited to the metal powder, and may not at all necessary to be mixed.

In the above-described embodiment, between two pairs of the lateral surfaces of the weight body portion 2, which surround one pair of lateral surfaces of the weight body portion that are disposed perpendicular to the inserting direction of the weight body portion 2 into the attachment space 6, the corrugated portion 3 is provided to one pair of the lateral surfaces of the weight body portion 2, which interpose the weight body portion 2 therebetween. The corrugated portion 3 may be provided also to the other pair of the lateral surfaces.

In the above-described embodiment, the shape of the weight body portion 2 is in a rectangular parallelepiped shape. However, the shape is not limited such shape. For example, if the weight body portion 2 is cylindrical, the corrugated portion 3 may be provided to one portion or an entire portion of the lateral surface located around an axis extending in the inserting direction for inserting the weight body portion 2 into the attachment space 6. The corrugated portion 3 may be provided at three locations at even intervals around the inserting direction.

The above-described embodiment explained an example, in which the weight 1 is attached to the key 5 in a manner so as to have the static load of 45 g to 80 g. The static load of 50 g to 70 g may be more preferable in some cases, and 53 g to 57 g may be even more preferable in some other cases.

In the above-described embodiment, the example of a keyboard musical instrument is an electronic piano. However, a keyboard musical instrument is not limited to an electronic piano. The present invention may be also applied to, for instance, an electronic organ, a synthesizer and so on.

What is claimed is:

1. A weight for a key of a keyboard musical instrument that is to be inserted and secured in an attachment space, provided to the key, the weight comprising:

a weight body portion; and a corrugated portion, disposed in at least one portion of a lateral surface of the weight body portion, the lateral surface being located around an axis extending in an inserting direction of the weight body portion into the attachment space, the corrugated portion comprising a plurality of corrugations aligned in the inserting direction;

wherein the weight body portion and the corrugated portion are made of an elastic material;

wherein each of the corrugations is linearly formed along a direction perpendicular to the inserting direction.

2. The weight according to claim 1, wherein, when the weight is attached to the key, the key has a static load of 45 g to 80 g at a position 23 mm away from a tip of the key.

3. A key for a keyboard musical instrument, the key comprising:

a weight; and an attachment space, in which the weight is attached, the weight comprising:

a weight body portion; and a corrugated portion disposed in at least one portion of a lateral surface of the weight body portion, the lateral surface being located around an axis extending in an inserting direction of the weight body portion into the attachment space, the corrugated portion comprising a plurality of corrugations aligned in the inserting direction;

wherein the weight body portion and the corrugated portion are made of an elastic material;

wherein each of the corrugations is linearly formed along a direction perpendicular to the inserting direction.

* * * * *